US006984054B2

(12) United States Patent
Lai

(10) Patent No.: US 6,984,054 B2
(45) Date of Patent: Jan. 10, 2006

(54) ARTICULATED PORTABLE LAMP FIXTURE

(76) Inventor: Li-Chun Lai, 21F -1, No. 33, Sec. 1, Minsheng Rd., Panciao City, Taipei County (TW)

( * ) Notice: Subject to any disclaimer, the term of this patent is extended or adjusted under 35 U.S.C. 154(b) by 41 days.

(21) Appl. No.: 10/762,312

(22) Filed: Jan. 23, 2004

(65) Prior Publication Data

US 2005/0162852 A1 Jul. 28, 2005

(51) Int. Cl.
*F21V 4/04* (2006.01)

(52) U.S. Cl. ..... 362/199; 362/287; 362/109

(58) Field of Classification Search ..... 362/285, 362/287–288, 109, 269, 199
See application file for complete search history.

(56) References Cited

U.S. PATENT DOCUMENTS 1,722,773 A * 7/1929 Stewart ..... 248/229.16
4,678,153 A * 7/1987 Maddock et al. ..... 248/229.13
5,414,608 A * 5/1995 Stekelenburg ..... 362/396
5,541,822 A * 7/1996 Bamber ..... 362/190
5,988,828 A * 11/1999 Prince et al. ..... 362/191
6,176,592 B1 * 1/2001 Kovacik et al. ..... 362/199
6,419,377 B1 * 7/2002 Yuen ..... 362/399
6,457,841 B1 * 10/2002 Lynch et al. ..... 362/199
6,585,400 B2 * 7/2003 Leen ..... 362/418
6,802,623 B1 * 10/2004 Hsu et al. ..... 362/199
2002/0097583 A1 * 7/2002 Yuen ..... 362/399
2003/0231491 A1 * 12/2003 Shih ..... 362/199

* cited by examiner

*Primary Examiner*—Sandra O'Shea
*Assistant Examiner*—Ali Alavi
(74) *Attorney, Agent, or Firm*—Rosenberg, Klein & Lee

(57) ABSTRACT

The disclosed herein is an articulated portable lamp fixture composed of a grip and a fixture body developable and retractable by articulation motion and can be fixed at any desired angle step by step by trapping a stop block formed on the fixture body in one of the confinement grooves formed on the articulation of the grip so that this portable lamp is easy to use while providing the best lighting efficiency, and convenient to put away without occupying large space when being not in use.

7 Claims, 3 Drawing Sheets

ARTICULATED PORTABLE LAMP FIXTURE

BACKGROUND OF THE INVENTION

1. Field of the Invention

The present invention relates to an articulated portable lamp fixture, and more particularly, a portable lamp fixture which is developable and retractable by articulation motion, and can be fixed at any desired angle step by step by trapping a stop block into a confinement groove so that this portable lamp is convenient to use and put away.

2. Description of the Prior Art

It is very inconvenient and annoying to look for something in a dark place without using a lamp to light. A portable lamp may be helpful in this occasion.

If the portable lamp is too large in size, it is inconvenient to handle when in use and occupies a large space to put away when not in use. On the other hand, though a small lamp is easy to handle, the area it can illuminate is limited and the light intensity it can provide is too weak.

In view of this, if a portable lamp fixture is made into developable and retractable structure, the inherent shortcomings which the user is presently suffering form will be solved.

It is what the reson the inventor has put forth every effort for years by continuous research and experimentation intending to discover the remedy to palliate the shortcomings of the structure of the conventional portable lamp described above, and at last succeeded in realizing the present invention.

SUMMARY OF THE INVENTION

It is an object of the present invention to provide an articulated portable lamp fixture which can be developed and retracted by articulation motion so as to be handled easily when being in use and put away conveniently when being not in use.

It is another object of the present invention to provide an articulated portable lamp fixture which can be developed to fix at any desired angle where it may provide the best lighting effect for the user.

To achieve the above mentioned objects, the lamp fixture of the present invention is essentially composed of a grip and a fixture body. An articulation is provided at the top part of the grip with two hinge pins each protruded from one side of the articulation. An aperture is opened at a proper position at one of the two hinge pins to provide access for the electrical wiring to the fixture body. A washer is provided for each of the hinge pins so as to fix the grip tightly to the fixture body. Several straight confinement grooves are parallelly formed along the surface of the articulation. A power outlet with a power supply conductor is provided to the bottom surface of the grip, and a switch is installed on the grip at a proper position thereof to make ON/OFF control for the power supply to the lamp; while the power outlet serves as a transit station for the power supply to other electric appliances.

Two lugs each having a recessed hinge hole at is inner wall are vertically erected on the lower end of the fixture body, and a spring leaf with a stop block is interposed between the two lugs. A hook with a rotatable ball end is formed on the top part of the fixture body so as to allow the hook revolvable with respect to the fixture body thereby facilitating the user to hang up the lamp fixture form various directions. By fitting the hinge pin on the grip into the hinge hole of the fixture body, the grip and the fixture body can be steadfastly combined together to allow the grip to make articulation motion with respect to the fixture body and pause step by step at the position when the stop block protruded on the spring leaf comes to be trapped in one of the confinement grooves provided on the articulation of the grip such that the lamp fixture can be developed to be fixed at any desired angle convenient to provide the best lighting effect.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
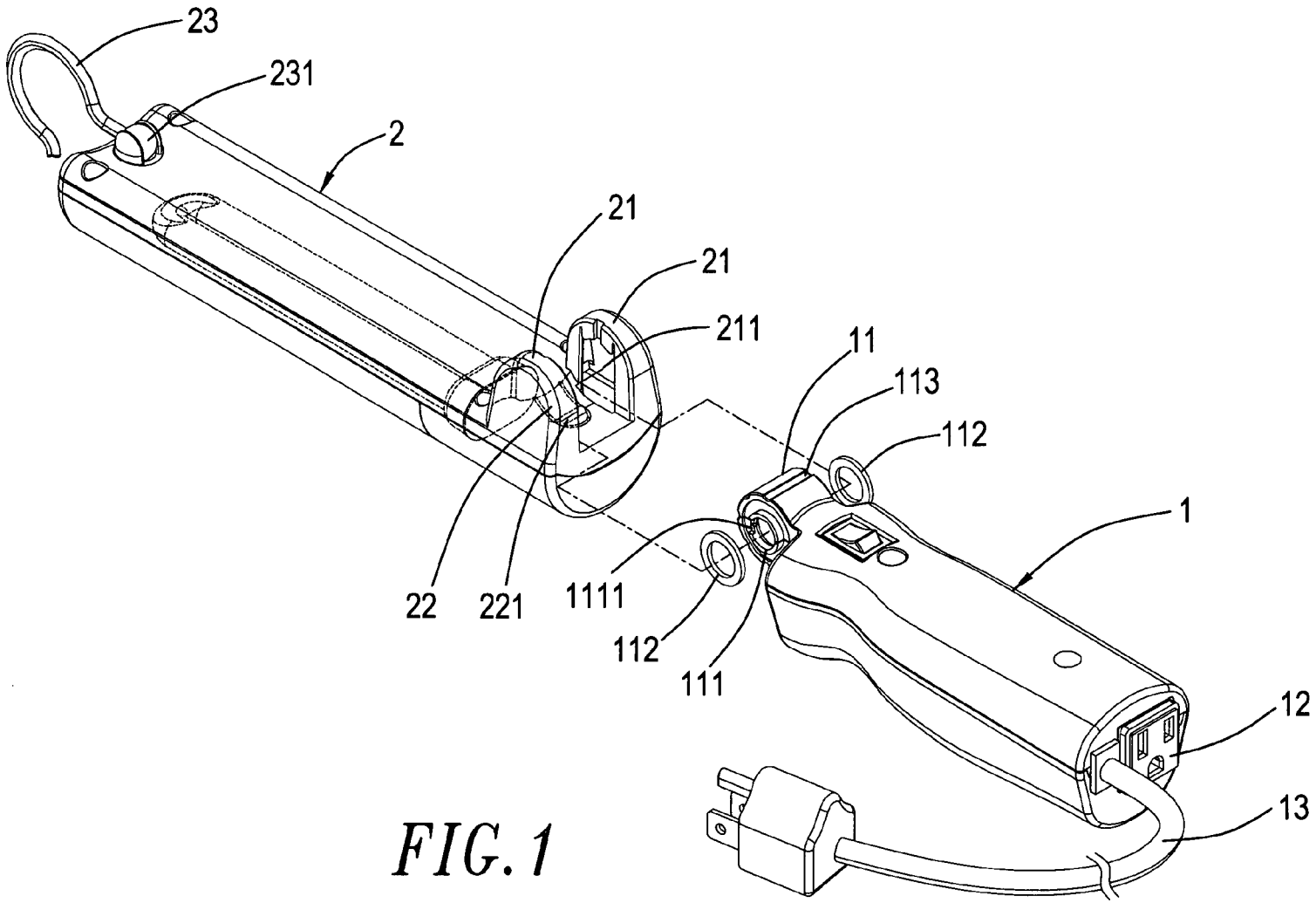
FIG. 1 is a three dimensional exploded view of the present invention.
Figure 2:
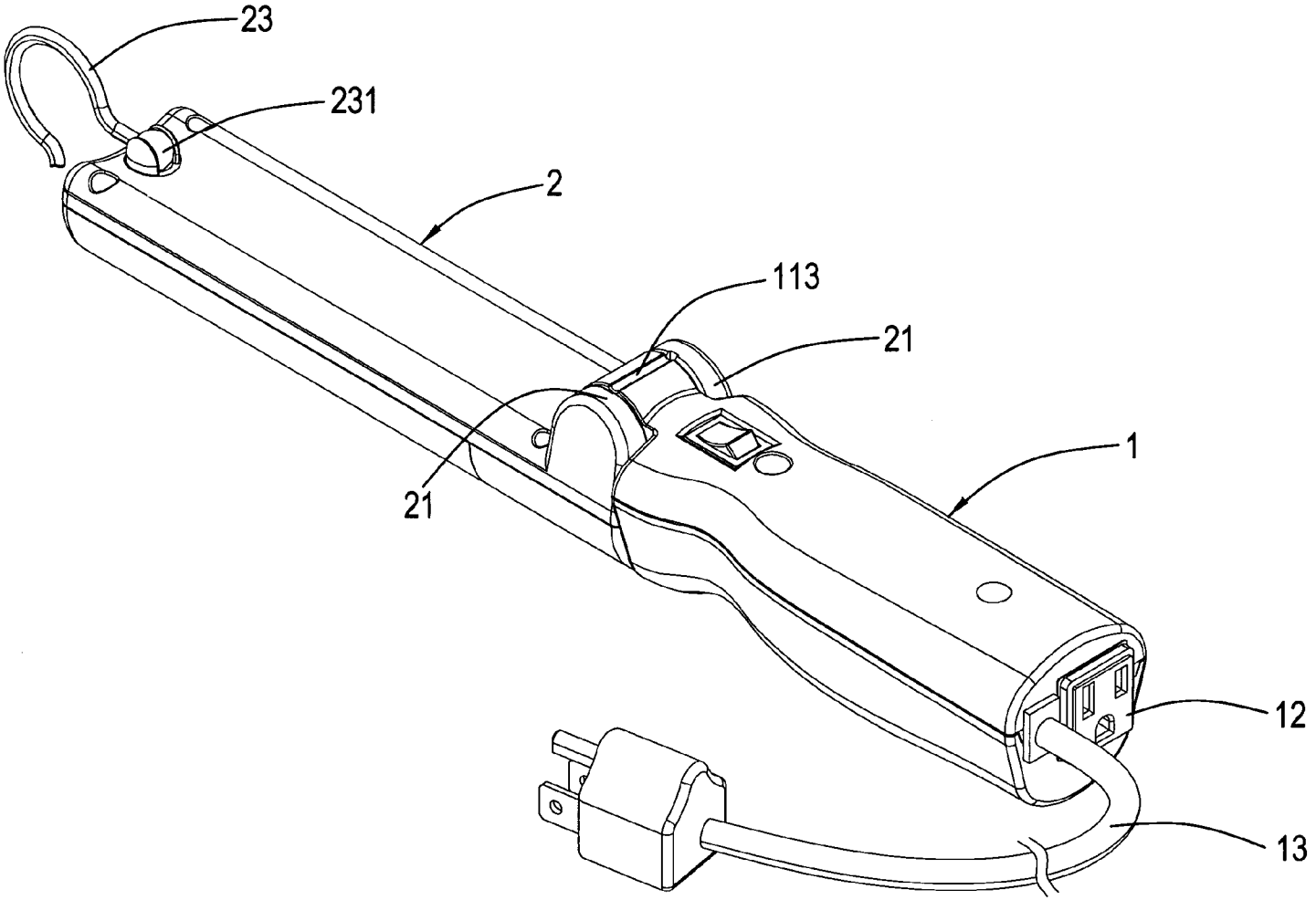
FIG. 2 is a three dimensional assembly view of the present invention.
Figure 3:
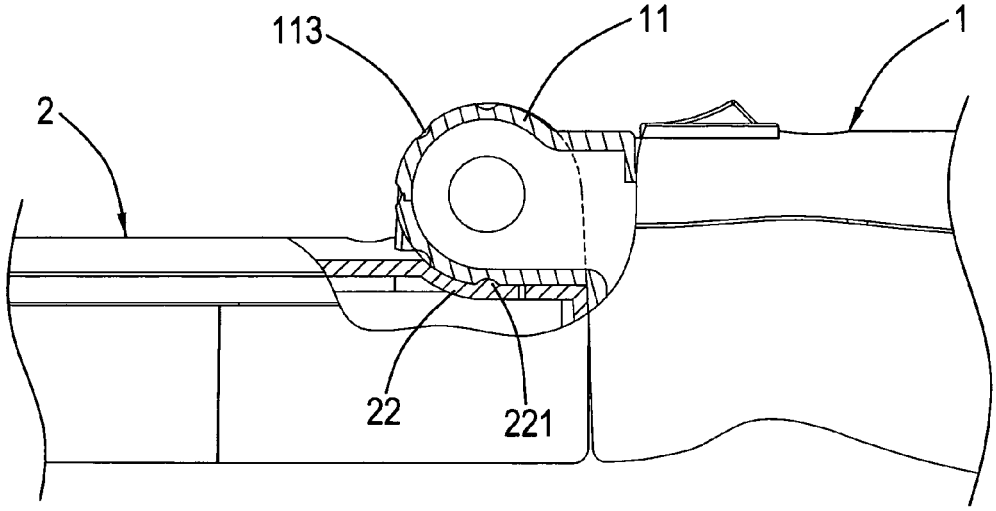
FIGS. 3(A) and 3(B) are the illustrative views of the articulation motion of the present invention.
Figure 3:
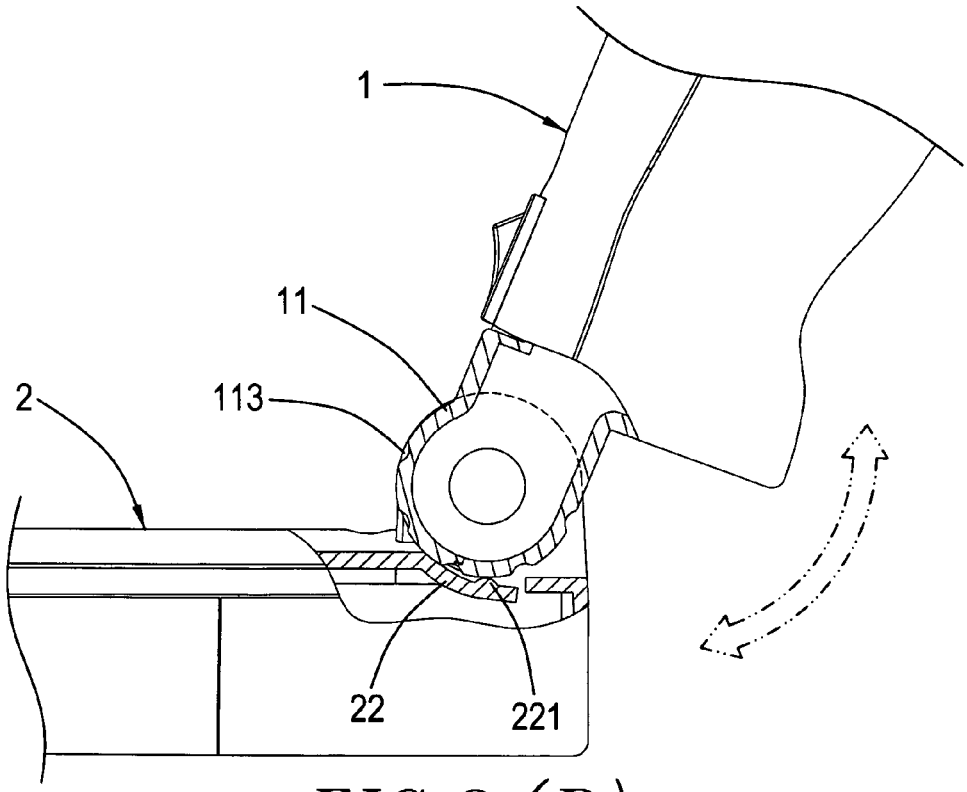

Referring to FIG. 1 through FIG. 3, the articulated portable lamp fixture of the present invention is essentially composed of a grip 1 and a fixture body 2. An articulation 11 is provided at the top part of the grip 1 with two hinge pins 111 each protruded from one side of the articulation 11. An aperture 1111 is opened at a proper position at one of the two hinge pins 111 to provide access for the electrical wiring to the fixture body 2. A washer 112 is provided for each of the hinge pins 111 so as to fix the grip 1 tightly to the fixture body 2. Several straight grooves 113 are formed in parallel along the surface of the articulation 11. A power outlet 12 with a power supply conductor 13 is provided to the bottom surface of the grip 1, and a switch is installed on the grip 1 at a proper position thereof to make ON/OFF switching for the power supply to the lamp; while the outlet 12 serves as a transit station for the power to other electric appliances.

Two lugs 21 each having a recessed hinge hole 211 at its inner wall are vertically erected on the lower end of the fixture body 2, and a sping leaf 22 with a stop block 221 is interposed betweent he two lugs 21. A hook 23 with a rotatable ball end 231 is formed on the top part of the fixture body 2 so as to allow the hook 23 revolvable with respect to the fixture body 2 thereby facilitating the user to hang up the lamp fixture from any direction. By fitting the hinge pins 111 of the grip 1 into the hinge holes 211 of the fixture body 2, the grip 1 and the fixture body 2 can be steadfastly combined together to allow the grip 1 to make articulation motion with respect to the fixture body 2 and pause step by step at the position when the stop block 221 protruded from the spring leaf 22 comes to be trapped in one of the confinement grooves 113 provided on the articulation 11 of the grip 1 such that the lamp fixture can be developed to be fixed at any desired angle convenient to provide the best lighting effect.

It emerges from the above description that the articulated portable lamp fixture of the present invention has several noteworthy advantages, in particular:

1. That it can be developed and retracted by articulation motion so that it can be handled easily when being in use and put away conveniently without occupying too large space at leisure.
2. That it can be developed to fix at any desired angle where it may provide the best lighting effect.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An articulated portable lamp fixture comprising:

a grip with an articulation provided at the top part thereof, wherein each of two hinge pins is protruded from a respective side of said articulation, and a plurality of straight confinement grooves are formed in parallel along the surface of said articulation;

a fixture body with two lugs each having a recessed hinge hole at its inner wall being vertically erected on the lower end of said fixture body, wherein a spring leaf with a stop block is interposed between said two lugs, and said two hinge holes are for mating with said two hinge pins;

by combining said fixture body and said grip with said hinge pins, said grip being allowed to make articulation motion with respect to said fixture body and pause step by step in position when said stop block comes to be trapped in one of said confinement grooves such that said lamp fixture can be developed to fix at any desired angle.

2. The articulated portable lamp fixture as in claim 1, wherein an aperture is opened at a proper position at one of said two hinge pins to provide access for the electrical wiring to the fixture body.

3. The articulated portable lamp fixture as in claim 1, wherein a washer is provided for each of said hinge pins so as to fix said grip tightly to said fixture body.

4. The articulated portable lamp fixture as in claim 1, wherein an electric switch is equipped on said grip for switching ON/OFF the power supply for the lamp in said fixture body.

5. The articulated portable lamp fixture as in claim 1, wherein an outlet is provided to the bottom of said grip for serving as a transit station for power supply to other loads.

6. The articulated portable lamp fixture as in claim 1, wherein an electric power supply conductor is provided to the bottom of said grip for supplying electric power to the lamp.

7. The articulated portable lamp fixture as in claim 1, wherein a hook is provided to the top part of said fixture body to hang up said lamp fixture.

* * * * *